US008960678B2

(12) United States Patent
Gilman

(10) Patent No.: US 8,960,678 B2
(45) Date of Patent: Feb. 24, 2015

(54) THRUSTBACK TRAINING SLED

(71) Applicant: Neil F. Gilman, South Glastonbury, CT (US)

(72) Inventor: Neil F. Gilman, South Glastonbury, CT (US)

(73) Assignee: Marty Gilman, Inc., Gilman, CT (US)

( * ) Notice: Subject to any disclaimer, the term of this patent is extended or adjusted under 35 U.S.C. 154(b) by 0 days.

(21) Appl. No.: 13/786,454

(22) Filed: Mar. 6, 2013

(65) Prior Publication Data

US 2013/0184104 A1 Jul. 18, 2013

Related U.S. Application Data

(63) Continuation-in-part of application No. 13/741,380, filed on Jan. 14, 2013, now abandoned.

(60) Provisional application No. 61/586,535, filed on Jan. 13, 2012.

(51) Int. Cl.
*A63B 69/34* (2006.01)

(52) U.S. Cl.
CPC ..... *A63B 69/345* (2013.01)
USPC ..... 273/445

(58) Field of Classification Search
USPC ..... 473/441–445, 438; 482/83–90
See application file for complete search history.

(56) References Cited

U.S. PATENT DOCUMENTS

| | | | | | |
|---|---|---|---|---|---|
| 2,162,073 | A * | 6/1939 | Evans | 473/442 |
| 2,183,465 | A * | 12/1939 | Noor | 73/379.04 |
| 2,440,577 | A * | 4/1948 | Denby | 473/441 |
| 3,216,724 | A * | 11/1965 | Williams | 473/445 |
| 3,674,265 | A * | 7/1972 | Sheets et al. | 473/441 |
| 3,997,160 | A * | 12/1976 | George | 473/444 |
| 4,720,103 | A * | 1/1988 | Palladino, Jr. | 473/438 |
| 4,943,057 | A * | 7/1990 | Felder | 473/445 |
| 5,385,523 | A * | 1/1995 | Forrest | 473/445 |
| 5,462,272 | A * | 10/1995 | Staten | 473/445 |
| 6,036,609 | A * | 3/2000 | Gilman | 473/445 |
| 6,458,051 | B1 * | 10/2002 | Moore | 473/445 |
| 6,824,504 | B2 * | 11/2004 | Ott | 482/92 |
| 8,002,649 | B2 * | 8/2011 | Forrest, Sr. | 473/445 |
| 8,226,503 | B2 * | 7/2012 | Rusch et al. | 473/445 |
| 8,617,007 | B2 * | 12/2013 | Gilman | 473/445 |
| 2008/0051228 | A1 * | 2/2008 | Harmon et al. | 473/445 |
| 2008/0058128 | A1 * | 3/2008 | Joseph | 473/441 |
| 2012/0157244 | A1 * | 6/2012 | Staten et al. | 473/445 |
| 2013/0143693 | A1 * | 6/2013 | Forrest, Sr. | 473/444 |

* cited by examiner

*Primary Examiner* — Mark Graham
(74) *Attorney, Agent, or Firm* — Day Pitney LLP

(57) ABSTRACT

The disclosure includes a variety of thrustback sleds. In one embodiment, the disclosure provides a thrust back training sled, including a base including a plurality of horizontal runners, a generally horizontal rail assembly disposed on the base, a trolley assembly disposed on the generally horizontal rail assembly, the trolley assembly including a plurality of rollers received by the rail assembly, the trolley being adapted to translate from a first, forward position to a second, rearward position along the generally horizontal rail assembly. The sled can further include a generally horizontally oriented spring adapted to restrict horizontal movement of the trolley from the first position to the second position, a pivotable mounting plate pivotally attached to the trolley assembly, the pivotable mounting plate being adapted to rotate from a first lower position to a second, higher position about a center of rotation, and a generally vertically oriented spring adapted to restrict vertical movement of the pivotable mounting plate from the first position to the second position.

16 Claims, 14 Drawing Sheets

TOP VIEW OF ASSEMBLED THRUST BACK SLED 1-1 SECTION THROUGH ASSEMBLED THRUST BACK SLED

SECTION THROUGH TROLLEY WITH SPRING

PIVOT & SPRING TOP VIEW

TOP VIEW

OF MOUNTING PLATES

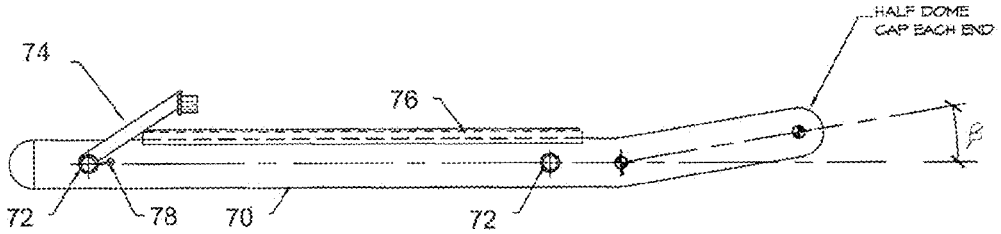
FIG. 10A LONG. SECTION
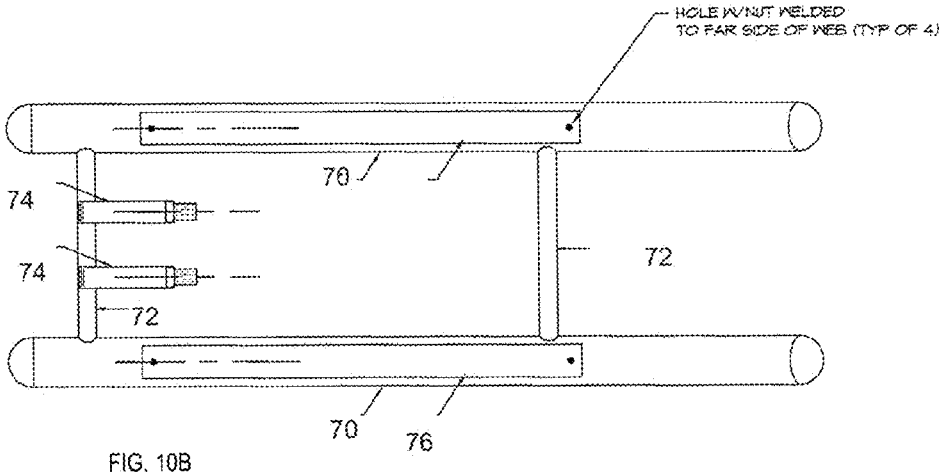
FIG. 10B SLED TOP VIEW

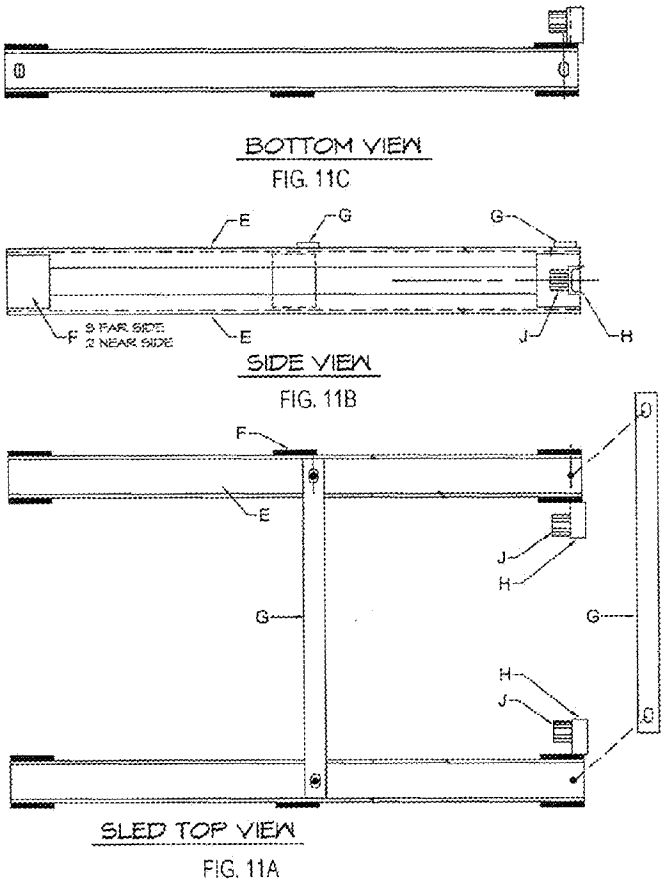
FIGURE 11 – Rail Assembly for Trolley

TROLLEY TOP VIEW

AXLE

RAIL DETAIL

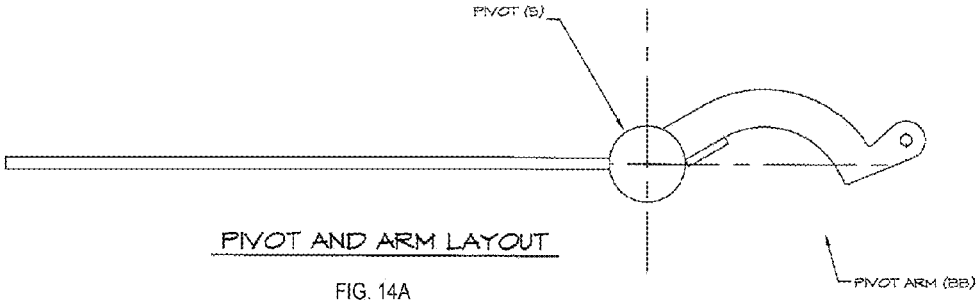
PIVOT AND ARM LAYOUT
FIG. 14A
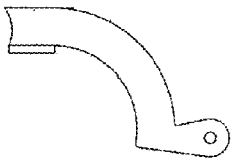
PIVOT ARM (BB)
FIG. 14B
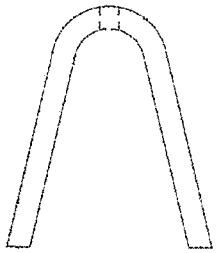
SPRING BRACKET (V)
FIG. 14C
FIG. 14

THRUSTBACK TRAINING SLED

CROSS-REFERENCE TO RELATED APPLICATION

This patent application is a continuation-in-part of and claims the benefit of priority to U.S. patent application Ser. No. 13/741,380, filed Jan. 14, 2013, which in turn claims the benefit of priority to U.S. Provisional Application No. 61/586,535, filed Jan. 13, 2012. Each of the aforementioned patent applications is incorporated by reference herein in its entirety for any purpose whatsoever.

BACKGROUND

1. Field of the Disclosure

The present disclosure relates to methods, systems and articles for strength and agility training. Particularly, the present disclosure is directed to a training sled that provides predefined and controllable amounts of resistance against an applied force of an athlete.

2. Description of Related Art

A variety of sleds are known in the art for football training, for example, that have pads that are pushed into or charged by a user to enhance power and speed of athletic skills such as rushing, blocking and tackling. While many of these sleds are well-known, sleds in the art suffer from certain disadvantages. The present disclosure provides solutions for these problems, as described below.

SUMMARY OF THE DISCLOSURE

Advantages of the present disclosure will be set forth in and become apparent from the description that follows. Additional advantages of the disclosure will be realized and attained by the methods and systems particularly pointed out in the written description and claims hereof, as well as from the appended drawings.

To achieve these and other advantages and in accordance with the purpose of the disclosure, as embodied herein, the disclosure includes a training sled, including a base portion including at least one horizontal rail, a trolley disposed on the at least one rail including a dummy mounted thereon, a first tension spring adapted to prevent horizontal movement of the trolley, and a second tension spring adapted to resist vertical movement of the dummy.

The disclosure also provides a thrust back training sled, including a base having a plurality of horizontal runners, a generally horizontal rail assembly disposed on the base, a trolley assembly disposed on the generally horizontal rail assembly, the trolley assembly including a plurality of rollers received by the generally horizontal rail assembly. The trolley is adapted to translate from a first, forward position to a second, rearward position along the generally horizontal rail assembly. The sled also includes a generally horizontally oriented spring adapted to prevent horizontal movement of the trolley from the first position to the second position.

The sled can also include a pivotable mounting plate pivotally attached to the trolley assembly, the pivotable mounting plate being adapted to rotate from a first lower position to a second, higher position about a center of rotation, and/or a generally vertically oriented spring adapted to prevent vertical movement of the pivotable mounting plate from the first position to the second position. A tackling dummy can be attached to the pivotable mounting plate. The tackling dummy can be adapted to be moved backward to energize the horizontal spring and upward to energize the vertical spring upon application of a backward and upward force.

In further embodiments, the base of the sled can include three or more runners, and the sled can further include a second generally horizontal rail assembly disposed on the base parallel to the first generally horizontal rail assembly, a second trolley assembly disposed on the second generally horizontal rail assembly, the second trolley assembly including a second plurality of rollers received by the second generally horizontal rail assembly, the second trolley being adapted to translate from a first, forward position to a second, rearward position along the second generally horizontal rail assembly, and a second generally horizontally oriented spring adapted to prevent horizontal movement of the trolley from the first position to the second position.

If desired, base can includes at least four runners, and the sled further can include a third generally horizontal rail assembly disposed on the base parallel to the first and second generally horizontal rail assemblies, a third trolley assembly disposed on the third generally horizontal rail assembly, the third trolley assembly including a third plurality of rollers received by the third generally horizontal rail assembly, the third trolley being adapted to translate from a first, forward position to a second, rearward position along the third generally horizontal rail assembly, and a third generally horizontally oriented spring adapted to prevent horizontal movement of the trolley from the first position to the second position.

The disclosure also provides a thrust back training sled, including a base including a plurality of horizontal runners, a pivotable mounting plate pivotally attached to the base, the pivotable mounting plate being adapted to rotate from a first lower position to a second, higher position about a center of rotation, and a generally vertically oriented spring adapted to prevent vertical movement of the pivotable mounting plate from the first position to the second position. The sled can further include a generally horizontal rail assembly disposed on the base, a trolley assembly disposed on the generally horizontal rail assembly, the trolley assembly including a plurality of rollers received by the generally horizontal rail assembly, the trolley being adapted to translate from a first, forward position to a second, rearward position along the generally horizontal rail assembly, and a generally horizontally oriented spring adapted to prevent horizontal movement of the trolley from the first, forward position to the second, rearward position.

The disclosure also provides a thrust back training sled, including a base including a plurality of horizontal runners, a generally horizontal rail assembly disposed on the base, a trolley assembly disposed on the generally horizontal rail assembly, the trolley assembly including a plurality of rollers received by the rail assembly, the trolley being adapted to translate from a first, forward position to a second, rearward position along the generally horizontal rail assembly, a generally horizontally oriented spring adapted to prevent horizontal movement of the trolley from the first position to the second position, a pivotable mounting plate pivotally attached to the trolley assembly, the pivotable mounting plate being adapted to rotate from a first lower position to a second, higher position about a center of rotation, and a generally vertically oriented spring adapted to prevent vertical movement of the pivotable mounting plate from the first position to the second position.

It is to be understood that the foregoing general description and the following detailed description are exemplary and are intended to provide further explanation of the disclosed embodiments.

The accompanying drawings, which are incorporated in and constitute part of this specification, are included to illustrate and provide a further understanding of the method and system of the disclosed embodiments. Together with the description, the drawings serve to explain principles of the disclosed embodiments.

BRIEF DESCRIPTION OF THE DRAWINGS

FIGS. 10A-10B are side and top views of the sled base for a single thrust back sled.

FIGS. 11A-C are views of the rail assembly for receiving the trolley therein.

FIGS. 14A-C illustrates pivot and arm components and layout.

DETAILED DESCRIPTION OF PREFERRED EMBODIMENTS

Figure 1:
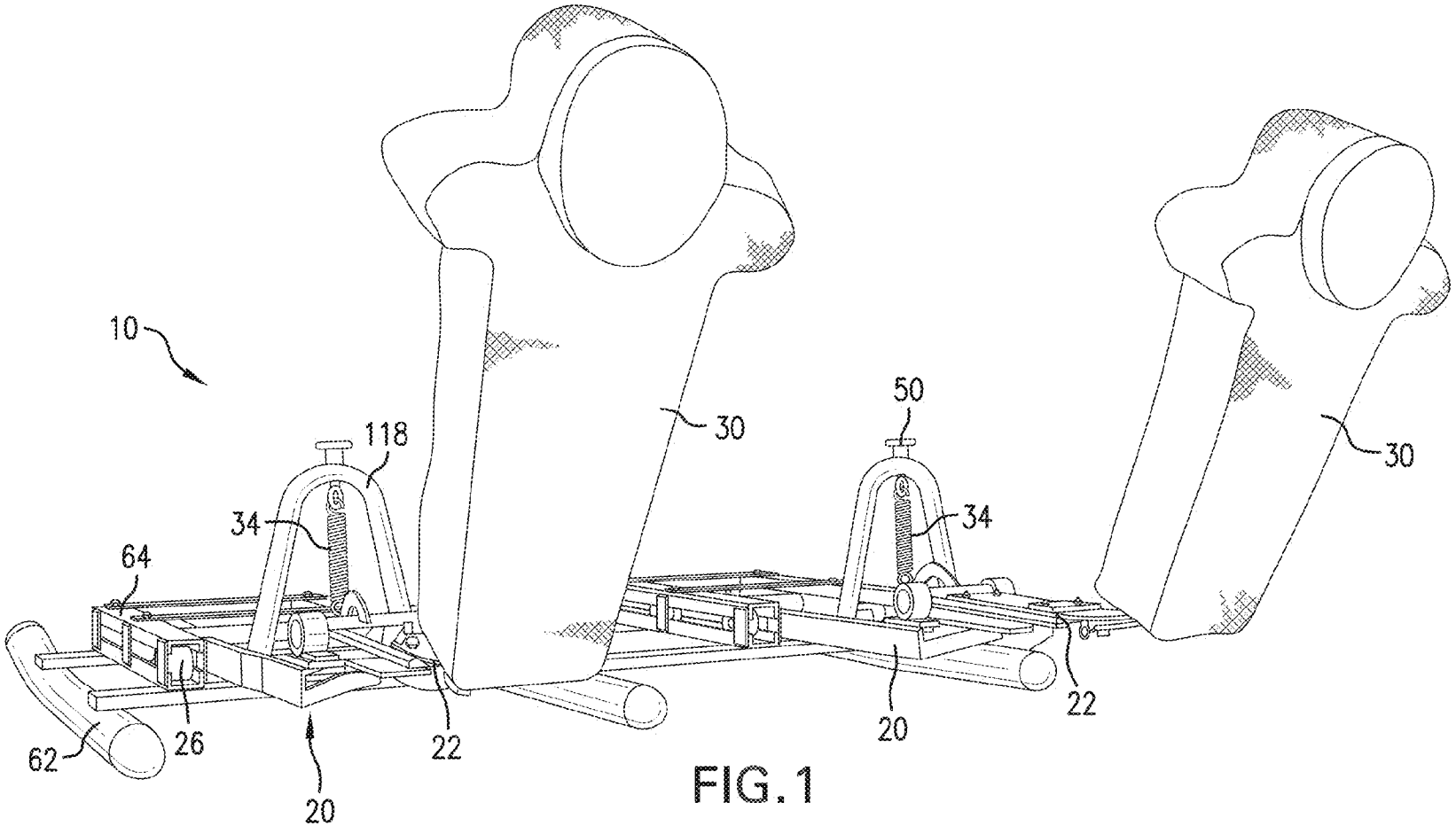
FIG. 1 is a view of a double thrust back sled made in accordance with the disclosure.
Figure 2:
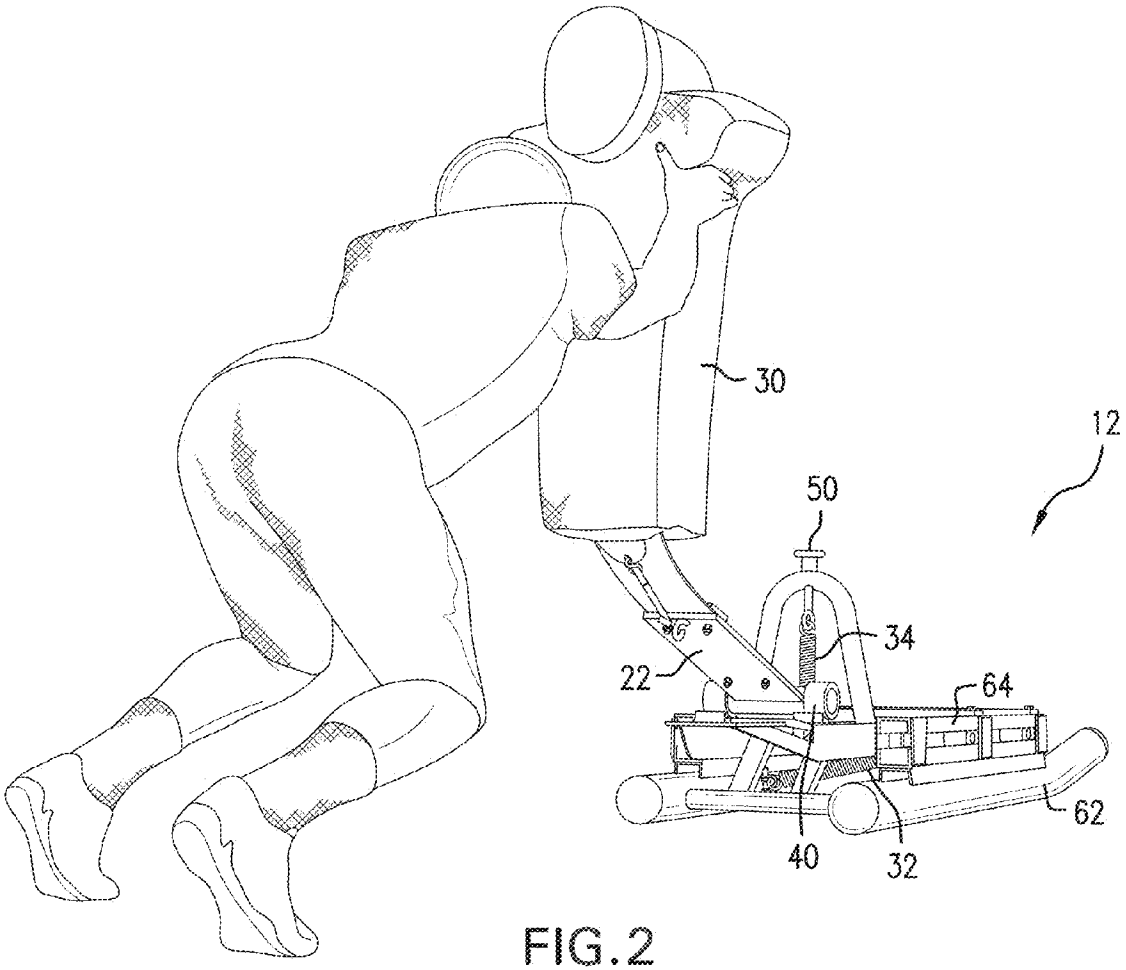
FIG. 2 is a view of a single thrust back sled made in accordance with the disclosure.

Reference will now be made in detail to the present preferred embodiments of the disclosure, examples of which are illustrated in the accompanying drawings.

Applicant has come to appreciate that there is a need in the game of football for teaching the technique of tackling and blocking whereby the player "drives" the dummy back a desired distance, such as at least 2 feet and must bring his feet in to drive the dummy back that distance.

For purposes of illustration, and not limitation, as embodied herein, single and double thrustback sleds 10 and 12 are illustrated. Each sled includes one trolley 20 (in the case of a single thrustback sled) or more trolleys (e.g., two in the case of a double thrustback sled) that roll backward along a horizontal direction after being struck by a user. However, the trolley 20 includes a pivotable mounting plate 22 that permits the dummy 30 to be lifted in the air by a desired distance at the same time it is being driven backwards. One or more resistance springs can be provided of a predetermined resistance to resist movement backwardly and upwardly, as desired. As illustrated, one spring 32 that is horizontally mounted resists horizontal movement, while a vertically oriented spring 34 resists vertical movement. The horizontal resistance spring 32 that is depicted can be provided in different initial tensions, such as 90 pounds, 120 pounds and 150 pounds, or any other desired tension. The vertical resistance spring 34 can be provided in any desired amount, such as 45, 60, 75, 90, 115, 130 pounds, or the like. Any desired spring can be used in either location in any five pound increment, for example, from 20 pounds to 300 pounds, as desired.

Attached to a front end of the trolley 20 is a unique combination of pillow block circular hinges 40 with a bearing insert that allows a dummy 30 to be lifted 12" vertically. The thrustback hinge mechanism also has a vertical coil spring 34 that regulates the tension on the vertical resistance. By turning the knob 50 clockwise, you increase the tension on the coil spring 34. By turning the knob 50 counterclockwise the tension on the vertical coil spring 34 is loosened. To Applicant's knowledge, no other sled is available that offers a dummy with resistance along a horizontal plane controlled by a coil spring and trolley, or that offers a dummy with resistance along a vertical plane controlled by a coil spring and hinge, let alone a combination of both. As will be appreciated, the modular design enabling a double design (FIG. 1) can be used to provide 3, 4, 5, 6 and 7 man designs, as desired.

For purposes of illustration, and not limitation, the components of the disclosed sleds can be any desired combination of components and materials. As illustrated in the drawings, however, the illustrated sleds have the following components.

Figure 8A:
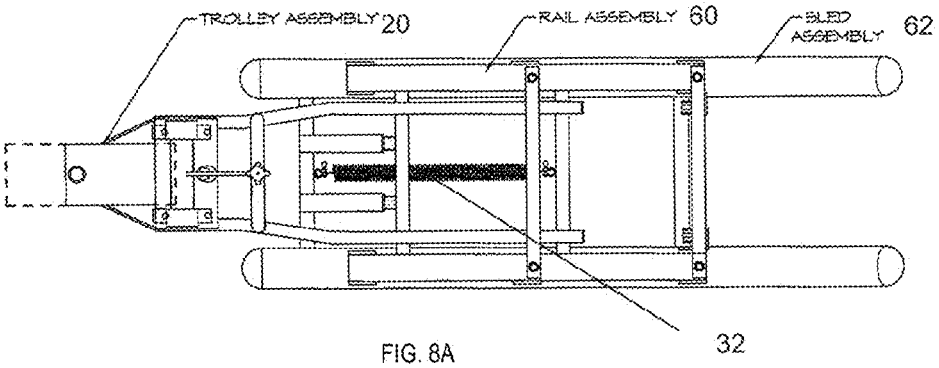
FIG. 8A is a top view of an assembled single thrust back sled.
Figure 8B:
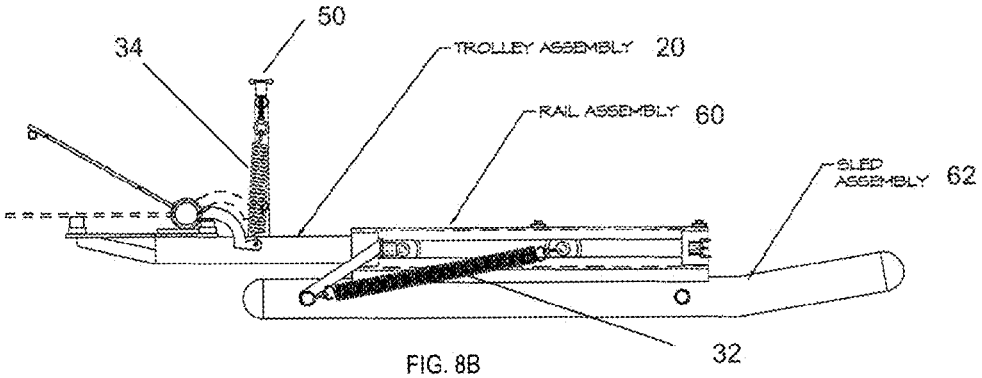
FIG. 8B is a cross section through the assembled thrust back sled of FIG. 8A.

As illustrated in FIGS. 8A-8B, the thrustback sled includes a sled assembly 62, a rail assembly 60 disposed on the sled assembly 62, and a trolley assembly 20 movably mounted on rollers 66, wherein the wheels 26 of the trolley assembly 20 are received within the rails 68 of the rail assembly 62. The trolley 20 is configured to travel from a first forward position to a second, rearward position against the force of a horizontal spring 32. The spring urges the trolley toward the first position.

The sled is illustrated in detail in FIGS. 10A-10B. As illustrated, the sled 62 includes two elongate parallel runners 70 having a first end and a second end, as well as rounded end caps, if desired. Any suitable material can be used. The depicted sled uses 4.0 inch diameter schedule 40 steel pipe with 4.5 inch diameter half dome caps at the end. The runners can have any suitable length, such as 3, 4, 5, 6, 7 or 8 feet in length. Runners 70 are connected to each other by transverse braces 72. Braces 72 can be any suitable material. In the depicted embodiment braces 72 are 1.5 inch diameter steel schedule 80 pipe. Braces 72 can be of any desired length, such as 10, 12, 14, 16, 18, 20, 22 or 24 inches, for example. Braces 72 can be bolted to or welded to runners 70, as desired.

A pair of stops 74 are mounted on the forward transverse brace 72, and are oriented at about a 45-degree angle with respect to a horizontal plane in which the sled rests. Stops 74 are preferably formed from metal, are preferably welded to brace 72, and preferably include rubber end stops for contacting the trolley when the trolley is urged forwards along the rails. Longitudinal channels 76 are mounted to (preferably welded onto) the top surface of the runners 70. As illustrated, channels 76 have a "U"-shaped cross-section defined by a flat base plate and upwardly extending walls. Channels 76 are inverted, such that the upwardly extending walls contact (and are preferably welded to) the top surface of the runners 70. A hole is drilled through each end of the base plate of the Channel 76 and a nut is welded to the lower face of the base plate that faces the runner in order to receive the rail assembly.

FIG. 11 illustrates various views and aspects of the rail assembly, which is in turn received by and bolted to the sled. As illustrated, each side of the rail assembly is formed from two elongate channels 80. Each channel has a "U"-shaped cross section, and the two channels are oriented such that the upper walls of each channel face each other. The channels 80 are joined to each other by a plurality of rectangular plates 82. As depicted, three plates are welded to the outboard face of the channels (at front, middle and rear locations) while two plates are welded to the inboard face of the channels to permit the trolley to travel substantially the full extent of the channels 80. The rear inner facing plate on each side includes a stop 84 attached thereto (e.g., by welding) and having a rubber or other shock absorbing material 85 affixed thereto. The stop assembly (84, 85) acts to stop the rearward motion of the trolley, such that the trolley can move between the stops 74 and the stops 84, 85 during use of the thrustback training sled. Once the trolley is mounted in the rails, the rails are attached to one another by way of elongate plates 86 which are bolted to the tops of the rails, while the bottoms of the rails are bolted in turn to the rails 76 of the sled. Plates 86 are provided with elongate holes at each end to facilitate alignment and assembly of the training sled.

Figure 7:
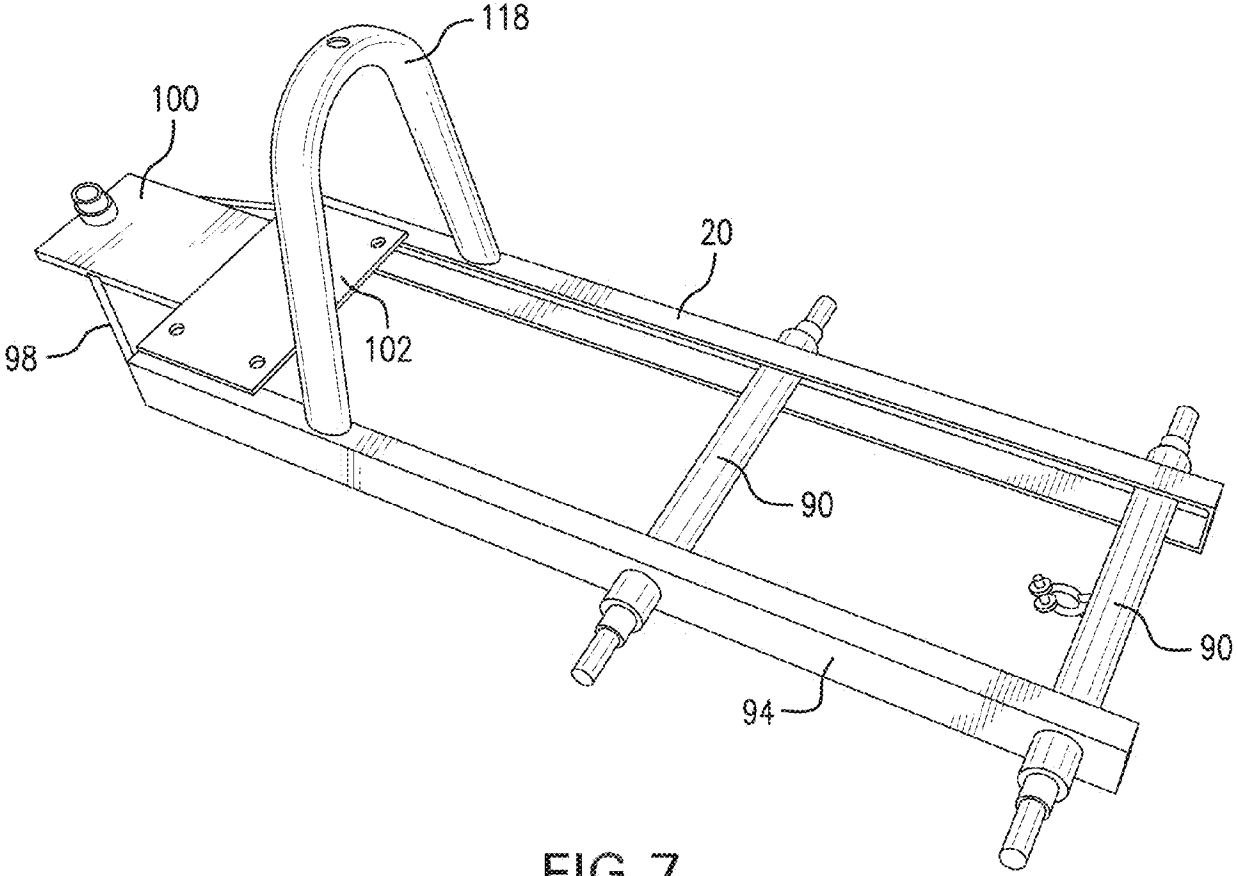
FIG. 7 is a perspective view of the trolley assembly.
Figure 12A:
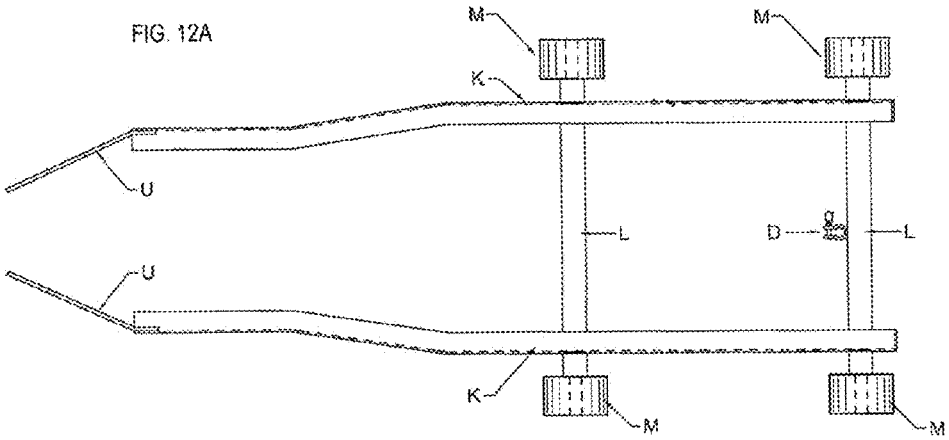
FIG. 12A is a top view of the trolley.
Figure 12C:
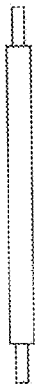
FIG. 12C is an axle for the trolley of FIG. 12A.
Figure 12B:
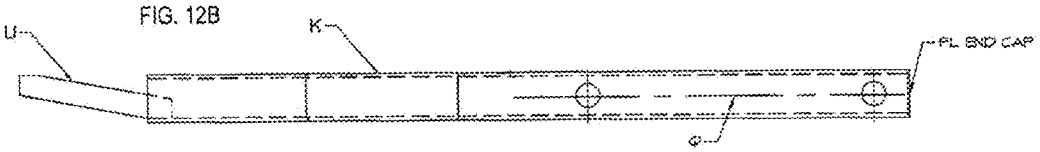
FIG. 12B is a side view of the trolley of FIG. 12A housed in the rail assembly.
Figure 13:
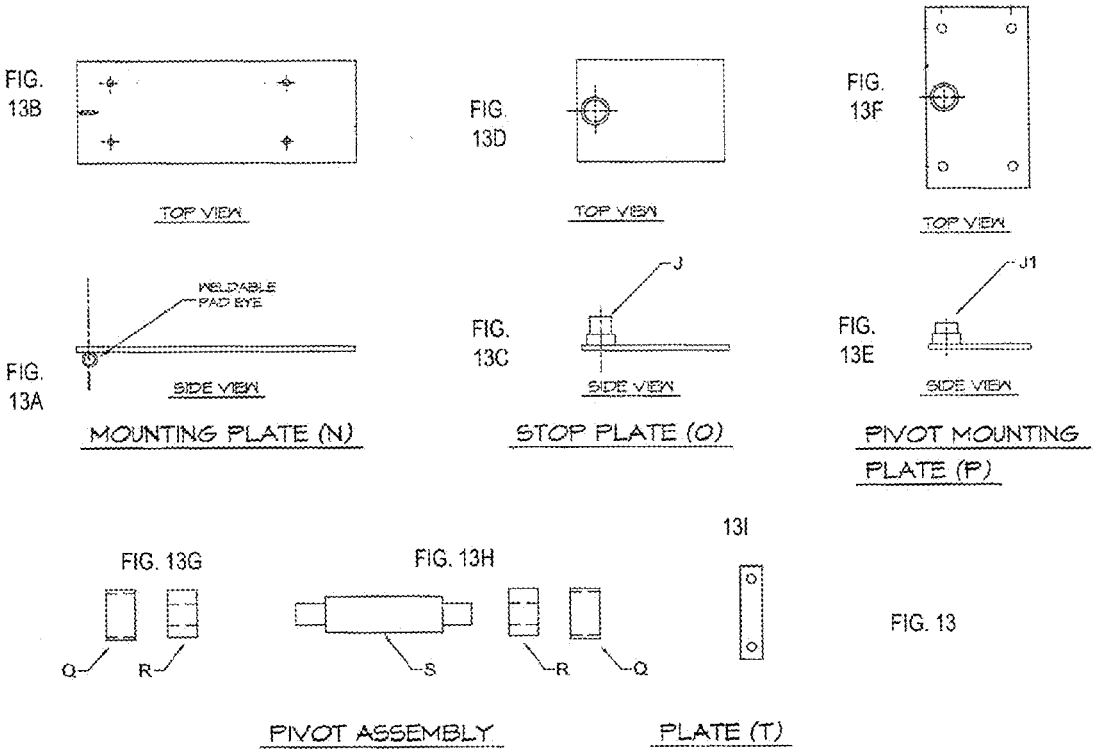
FIGS. 13A-I illustrates views of the mounting plate, the stop plate, the pivot mounting plate, the pivot assembly and a plate assembly.

The trolley and aspects thereof are illustrated in FIGS. 9,12 and 13. As illustrated in FIG. 12A, trolley includes a pair of generally parallel sides formed from "U"-channel material (e.g., steel) that each include two bends therein to form a first, rearward portion having parallel sides for receiving the axles 90 therein, a second, middle inwardly tapering portion and a second narrower front portion, also having parallel sides. The axles are preferably solid material, such as steel, and include reduced diameter spindles at the ends thereof for receiving wheels 92. As depicted in FIG. 7, the axles are welded to the sides and the wheels M are mounted onto spindles disposed at the ends of the axles. Wheels 92 can be made from any suitable material. The illustrated wheels 92 are preferably made from Nylatron® polymer and are preferably mounted on bearings which are, in turn received by the spindles. Wheels 92 can be held onto the spindles simply by the geometry of the device. For example, during assembly of the device, the rail assembly can be assembled around the trolley, and the wheels can be inserted into the rail assembly and then fitted onto the trolley. The combined assembly of the trolley and rails can then be bolted to the sled. The rearward axle includes a shackle with a pin 78 mounted thereto for receiving one end of the horizontal spring. The front portion of the side rails of the trolley are provided with inwardly oriented braces, that can also be formed from steel plate, and welded to the side rails 94 of the trolley.

Figure 3:
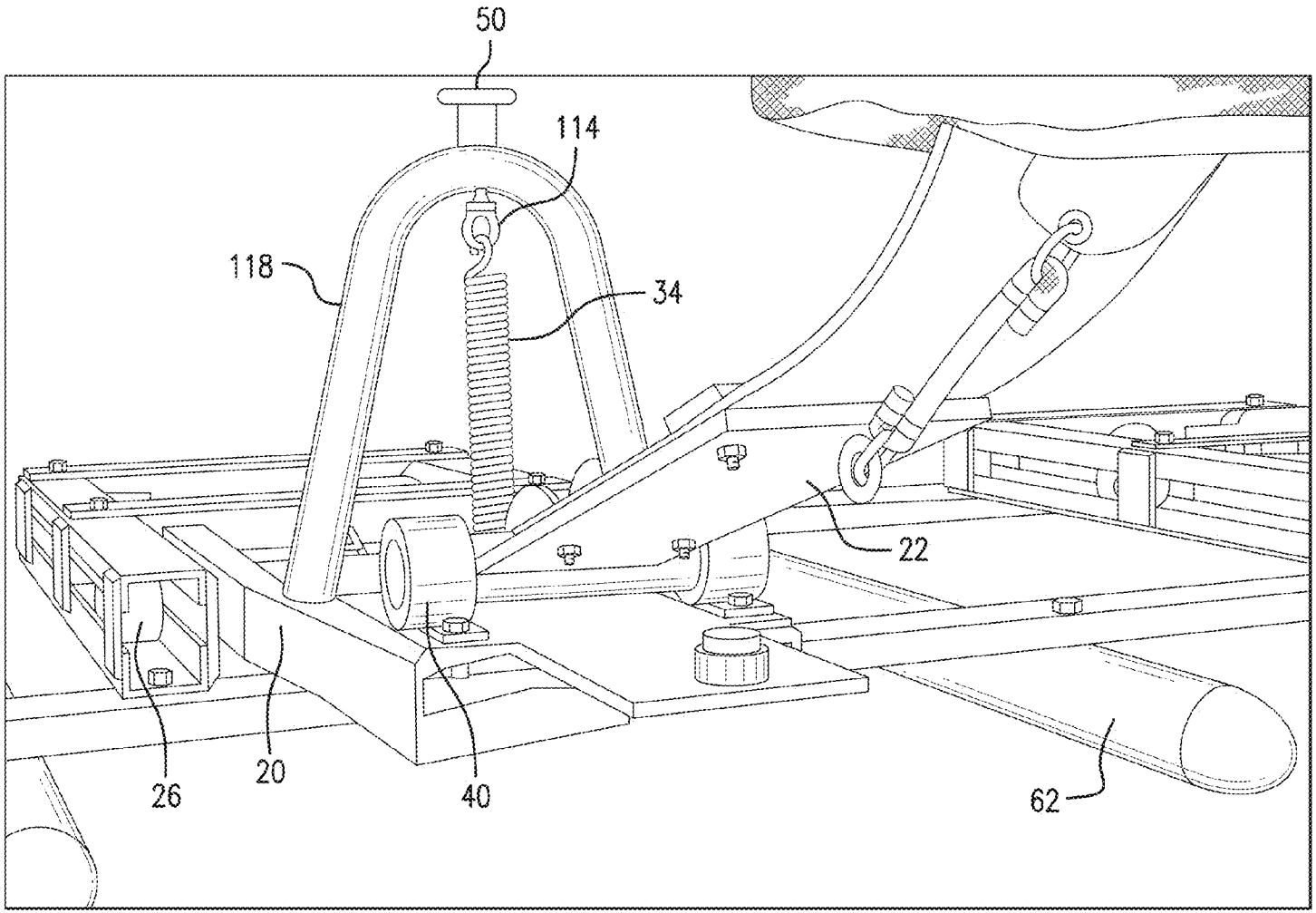
FIG. 3 is a close up view of a front portion of a thrust back sled in accordance with the disclosure having a dummy on a mounting plate in a raised, extended condition in typical use.
Figure 4:
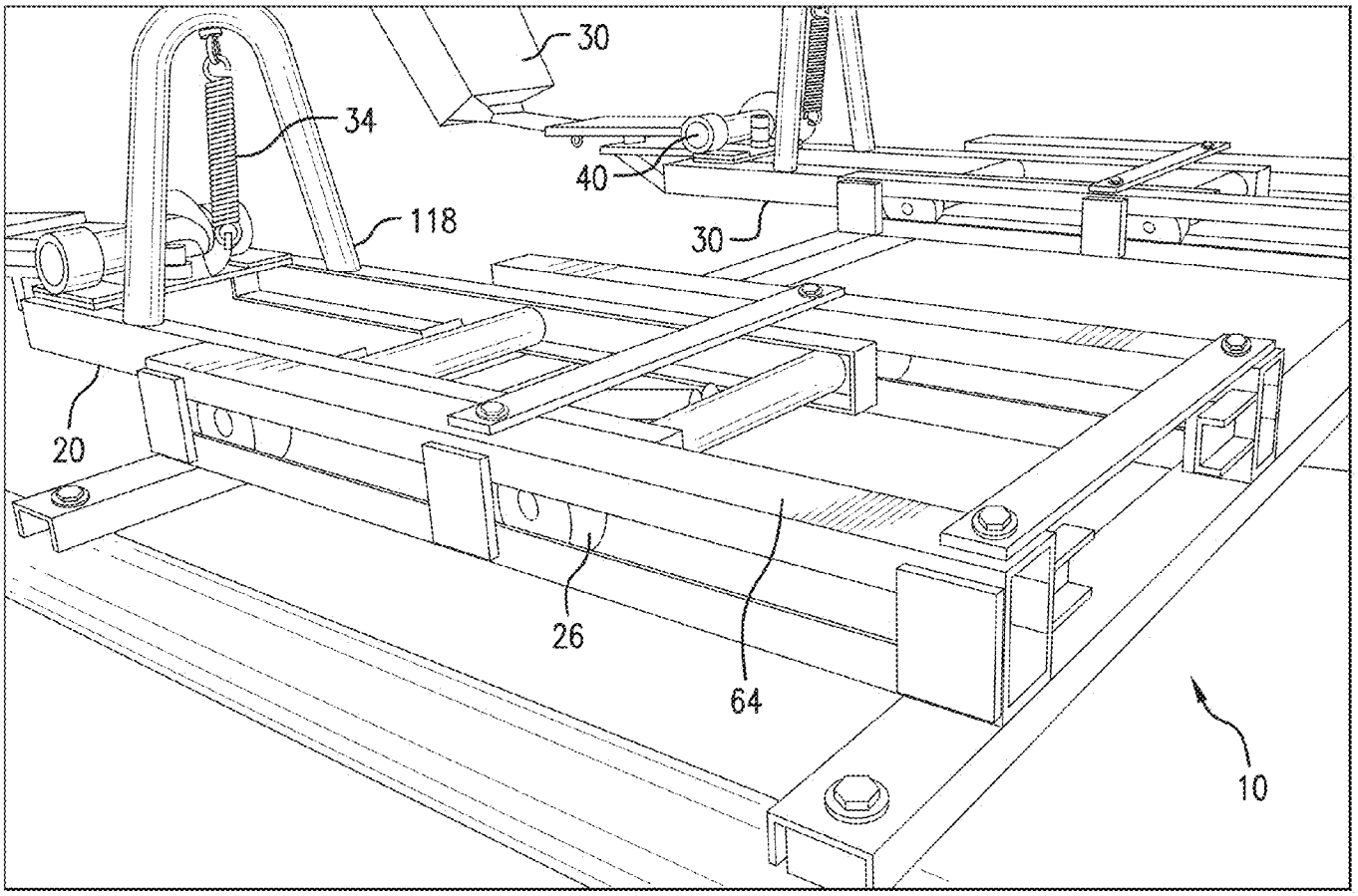
FIG. 4 is a side/rear perspective view of a double thrustback sled.
Figure 5B:
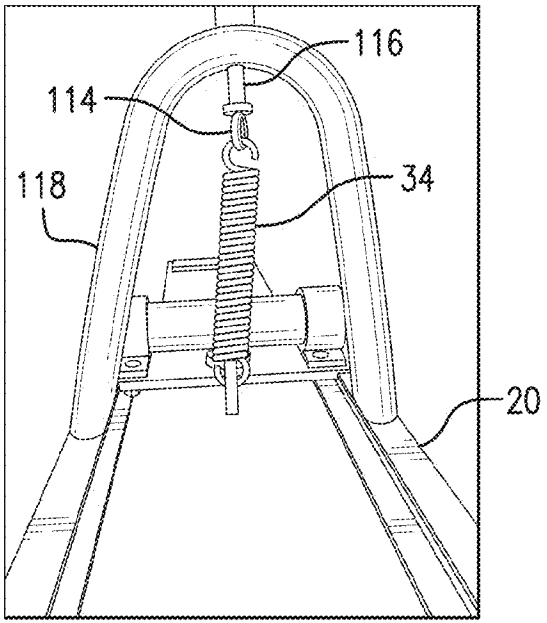
FIG. 5B is a view from the back end of a single thrust back sled toward the front end, illustrating positioning of the vertical resistance spring.
Figure 5A:
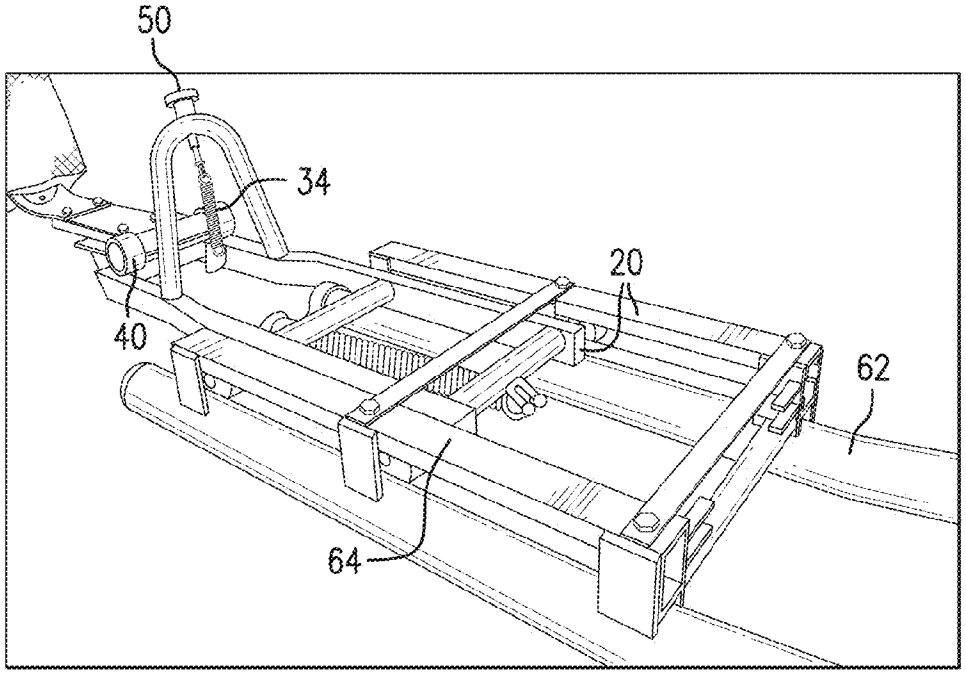
FIG. 5A is a side/rear perspective view of a single thrustback sled.
Figure 6A:
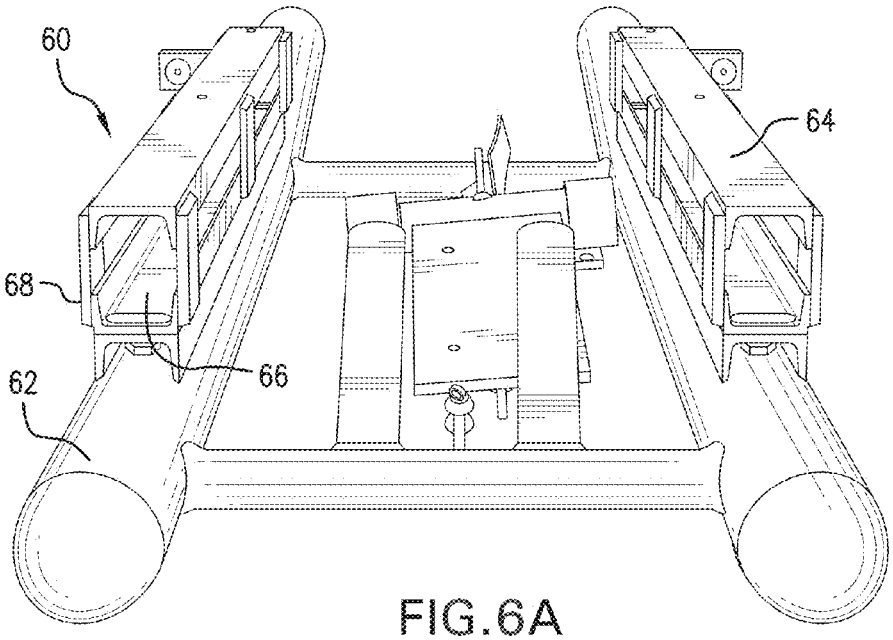
FIGS. 6A-6B are views of the sled and rail assembly without a trolley installed on the rail assembly.
Figure 6B:
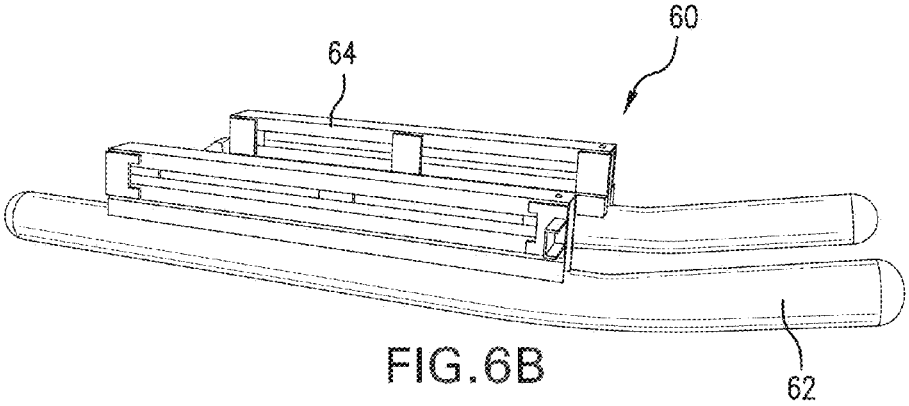
Figure 9A:
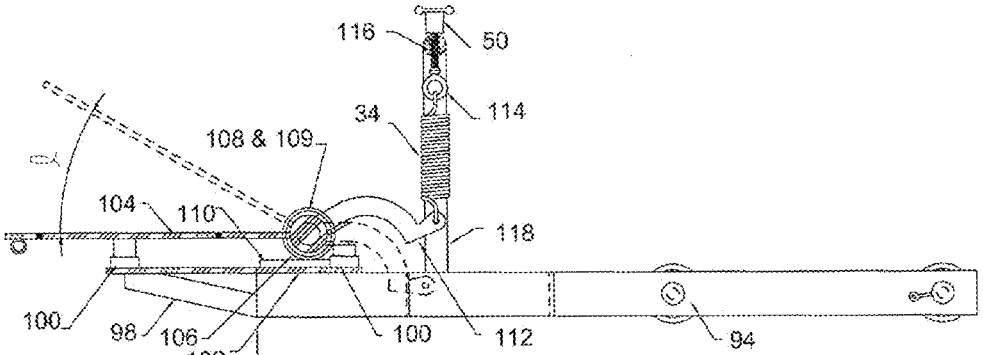
FIG. 9A is a section through a trolley assembly of a thrust back sled showing the vertical resistance spring.
Figure 9B:
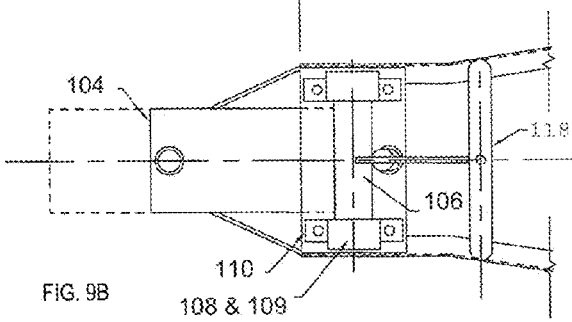
FIG. 9B is a top view of the assembly of FIG. 9A.
Figure 9C:
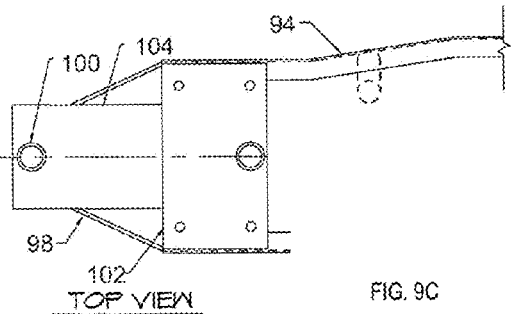
FIG. 9C is a top view of the mounting plates of the assembly of FIG. 9A.

FIGS. 9A-9C further illustrate the trolley. As set forth in FIGS. 9C and 7, two mounting plates 100 and 102 are welded to the rails 94 and supports 98 of the trolley. A stop or rest is formed on mounting plates 100 and 102 by attaching, for example, a short section of pipe with a rubber stop on the top face of the plate. The stop halts the downward movement of mounting plate 104, to which the tackling dummy is mounted. As illustrated, mounting plate 104 is welded to a pivot, or axle 106. Mounting plate 104 includes mounting holes thereon for receiving a mounting plate 22 of a tackling dummy thereon (FIG. 3), and includes a weldable pad eye for receiving a shock cord from the tackling dummy (FIG. 13A).

Pivot arm BB (further illustrated in FIG. 14) is also attached, such as by welding, to pivot 106. As depicted, pivot 106 is a solid steel rod that is milled down at each end to about 1.5 inch diameter with a 2 inch reduced diameter length on each end. Each of the reduced diameter ends of the pivot 106, are, in turn, received by a bushing 109 that is in turn received by a short section of pipe 108 that is welded to a plate 110. The plate 110 on each side of the assembly including the pivot 106, plate 104 and pivot arm 112 is bolted to plate 102. The vertical spring 34 is in turn attached through a drilled hole to the end of pivot arm 112 at its lower end. At its upper end, spring 34 is attached to an eye 114 that is attached to a bolt 116 that passes through a hole in spring bracket 118. Bolt 116 is received at its upper end by a threaded knob 50 that, when rotated, adjusts the amount of tension on the spring 34. Bracket 118 is preferably mandrel bent steel tubing that is in turn welded to side portions 94 of the trolley. A shackle with a pin 78 is similarly mounted to front transverse member 72 (FIG. 10A). The horizontal spring is thus mounted at its front end to the shackle and pin on front transverse member 72, and at its rear end to the shackle and pin 78 on the trolley discussed above.

In operation, when the tackling dummy is pushed upwardly, plate 104 pivots upwardly about pivot 106, and spring 34 becomes elongated, as illustrated in solid lines in FIG. 8B. When not in use, the spring contracts, returning plate 104 to its position on top of the stops mounted on plates 100 and 102.

The methods and systems of the disclosed embodiments, as described above and shown in the drawings, provide for exercise equipment and related techniques with superior attributes including improved safety and ease of use. It will be apparent to those skilled in the art that various modifications and variations can be made in the devices and methods of the disclosed embodiments without departing from the spirit or scope of the disclosure. Thus, it is intended that the disclosed embodiments include modifications and variations that are within the scope of the appended claims and their equivalents.

What is claimed is:

1. A thrust back training sled, comprising:

a) a base including a plurality of horizontal runners;

b) a pivotable mounting plate pivotally attached to the base, the pivotable mounting plate being adapted to rotate from a first lower position to a second, higher position about a center of rotation; and c) a generally vertically oriented spring adapted to restrict vertical movement of the pivotable mounting plate from the first position to the second position.

2. The sled of claim 1, further comprising:

a) a generally horizontal rail assembly disposed on the base;

b) a trolley assembly disposed on the generally horizontal rail assembly, the trolley assembly including a plurality of rollers received by the generally horizontal rail assembly, the trolley being adapted to translate from a first, forward position to a second, rearward position along the generally horizontal rail assembly; and c) a generally horizontally oriented spring adapted to restrict horizontal movement of the trolley from the first, forward position to the second, rearward position.

3. The sled of claim 2, further comprising a tackling dummy attached to the pivotable mounting plate, wherein the tackling dummy is adapted to be moved backward to energize the horizontal spring and upward to energize the vertical spring upon application of a backward and upward force.

4. The sled of claim 2, wherein the base includes at least three runners, and the sled further comprises:

a) a second generally horizontal rail assembly disposed on the base parallel to the first generally horizontal rail assembly;

b) a second trolley assembly disposed on the second generally horizontal rail assembly, the second trolley assembly including a second plurality of rollers received by the second generally horizontal rail assembly, the second trolley being adapted to translate from a first, forward position to a second, rearward position along the second generally horizontal rail assembly; and c) a second generally horizontally oriented spring adapted to restrict horizontal movement of the trolley from the first position to the second position.

5. The sled of claim 1, further comprising a control mechanism secured to the vertically oriented spring adapted to regulate tension on the vertically oriented spring.

6. The sled of claim 2, further comprising a stop adapted to stop rearward motion of the trolley.

7. A thrust back training sled, comprising:

a) a base including a plurality of horizontal runners;

b) a generally horizontal rail assembly disposed on the base;

c) a trolley assembly disposed on the generally horizontal rail assembly, the trolley assembly including a plurality of rollers received by the rail assembly, the trolley being adapted to translate from a first, forward position to a second, rearward position along the generally horizontal rail assembly;

d) a generally horizontally oriented spring adapted to restrict horizontal movement of the trolley from the first position to the second position;

e) a pivotable mounting plate pivotally attached to the trolley assembly, the pivotable mounting plate being adapted to rotate from a first lower position to a second, higher position about a center of rotation; and f) a generally vertically oriented spring adapted to restrict vertical movement of the pivotable mounting plate from the first position to the second position.

8. The sled of claim 7, further comprising a tackling dummy attached to the pivotable mounting plate, wherein the tackling dummy is adapted to be moved backward to energize the horizontal spring and upward to energize the vertical spring upon application of a backward and upward force.

9. The sled of claim 7, wherein the base includes at least three runners.

10. The sled of claim 9, wherein the sled further comprises:

a) a second generally horizontal rail assembly disposed on the base parallel to the first generally horizontal rail assembly;

b) a second trolley assembly disposed on the second generally horizontal rail assembly, the second trolley assembly including a second plurality of rollers received by the second generally horizontal rail assembly, the second trolley being adapted to translate from a first, forward position to a second, rearward position along the second generally horizontal rail assembly; and c) a second generally horizontally oriented spring adapted to restrict horizontal movement of the trolley from the first position to the second position.

11. The sled of claim 10, wherein the base includes at least four runners.

12. The sled of claim 11, wherein the sled further comprises:

a) a third generally horizontal rail assembly disposed on the base parallel to the first and second generally horizontal rail assemblies;

b) a third trolley assembly disposed on the third generally horizontal rail assembly, the third trolley assembly including a third plurality of rollers received by the third generally horizontal rail assembly, the third trolley being adapted to translate from a first, forward position to a second, rearward position along the third generally horizontal rail assembly; and c) a third generally horizontally oriented spring adapted to restrict horizontal movement of the trolley from the first position to the second position.

13. The sled of claim 7, further comprising a control mechanism secured to the vertically oriented spring adapted to regulate tension on the vertically oriented spring.

14. The sled of claim 7, further comprising a stop adapted to stop rearward motion of the trolley.

15. A thrust back training sled, comprising:

a) a base including a plurality of horizontal runners;

b) a generally horizontal rail assembly disposed on the base;

c) a trolley assembly disposed on the generally horizontal rail assembly, the trolley assembly including a plurality of rollers received by the generally horizontal rail assembly, the trolley being adapted to translate from a first, forward position to a second, rearward position along the generally horizontal rail assembly;

d) a pivotable mounting plate pivotally attached to the trolley assembly, the pivotable mounting plate being adapted to rotate from a first lower position to a second, higher position about a center of rotation and a generally vertically oriented spring adapted to restrict vertical movement of the pivotable mounting plate from the first lower position to the higher second position; and e) a generally horizontally oriented spring adapted to restrict horizontal movement of the trolley from the first, forward position to the second, rearward position.

16. The sled of claim 15, further comprising a tackling dummy attached to the pivotable mounting plate, wherein the tackling dummy is adapted to be moved backward to energize the horizontal spring and upward to energize the vertical spring upon application of a backward and upward force.

* * * * *